United States Patent [19]

Zimmermann

[11] 4,287,998

[45] Sep. 8, 1981

[54] DEW WORM CARTON

[75] Inventor: John Zimmermann, Scarborough, Canada

[73] Assignee: Somerville Belkin Industries Limited, London, Canada

[21] Appl. No.: 149,469

[22] Filed: May 13, 1980

Related U.S. Application Data

[63] Continuation-in-part of Ser. No. 17,252, Mar. 5, 1979, abandoned.

[51] Int. Cl.[3] ..... B65D 5/42; B65D 5/24; B65D 5/66

[52] U.S. Cl. ..... 229/16 R; 229/6 A; 229/DIG. 14; 229/43; 229/44 R; 206/631

[58] Field of Search ..... 229/16 R, 6 A, DIG. 4, 229/DIG. 14

[56] References Cited

U.S. PATENT DOCUMENTS

| | | | |
|---|---|---|---|
| 2,365,312 | 12/1944 | Trogman | 229/16 R X |
| 2,875,937 | 3/1959 | Vines | 229/16 R |
| 3,126,867 | 3/1964 | Kundikoff | 229/6 A X |
| 3,937,390 | 2/1976 | Winkler | 229/6 A X |

FOREIGN PATENT DOCUMENTS

| | | | |
|---|---|---|---|
| 1269909 | 7/1961 | France | 229/6 A |

*Primary Examiner*—Stephen P. Garbe
*Attorney, Agent, or Firm*—Fetherstonhaugh & Co.

[57] ABSTRACT

The invention relates to a paperboard container with small ventilation holes in the order of less than 3/32 of an inch in diameter. The holes are not punched but rather are formed by making small U-shaped cuts at a corner fold of the container blank and by making the corner fold in the reverse direction.

3 Claims, 6 Drawing Figures

DEW WORM CARTON

The application is a continuation-in-part of application Ser. No. 17,252 filed on Mar. 5, 1979 abandoned.

This invention relates to a paperboard container that must be provided with effective small ventilation holes for packaging live contents such as dew worms.

It is common to package bait for fishing in paperboard containers. These containers must be provided with ventilation holes. The holes must be small to prevent escape of the live bait.

Difficulty has been encountered in the past in providing small ventilating holes in paperboard containers of this type. In order to effectively contain dew worms the holes should be in the order of 1/16th of an inch in diameter. It is very difficult to maintain punches sharp for a hole of this size. Moreover, there is a tendency for the punched pieces of paperboard to accumulate in the punch and to fall from the punch during the punching operation as an accumulated mass. The dropping of a bunch of punched pieces in this way fouls the bending and cutting equipment.

It is, therefore, an object of this invention to provide a container for items such as bait that has small ventilating openings and that can be automatically manufactured on equipment without using punches to form the ventilating openings.

With these and other objects in view, a paperboard container according to this invention comprises a paperboard container blank having adjacent wall panels defined by fold lines that are die formed depressions in the inside faces of the container blank; U-shaped cuts in the blank interrupting the fold lines to form U-shaped tabs, the direction of the arms of the U being transverse of the direction of the fold lines, the tops of the arms of the U being on a first one of two adjacent panels adjacent a fold line, and the base of the U being in the second one of two adjacent panels; the distance between the arms of the U being less than 3/32 of an inch and the length of the arms being greater than the distance between them, the container being adapted for set-up by folding said blank about said fold line whereby said U-shaped tabs separate from said second panel and remain in the plane of said first panel to leave a ventilating opening in said second panel at the corner between said first panel and said second panel when the container is set up.

The invention will be clearly understood after reference to the following detailed specification read in conjunction with the drawings.

Figure 2:
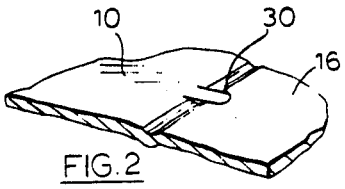
FIG. 2 is a view from the opposite side of the blank of FIG. 1 illustrating the crease lines.
Figure 2A:
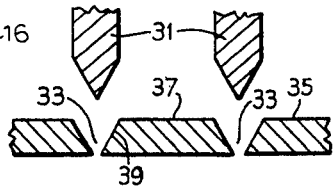

FIG. 2*a* is an enlarged sectional view of cutting rules after making a cut to illustrate the nature of the U-shaped cuts made from the inside face of the blank.

Figure 3:
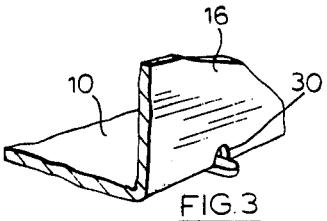
Figure 4:
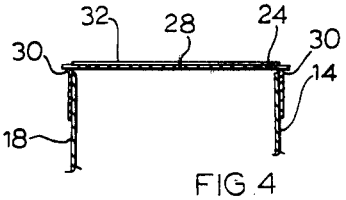
Figure 5:
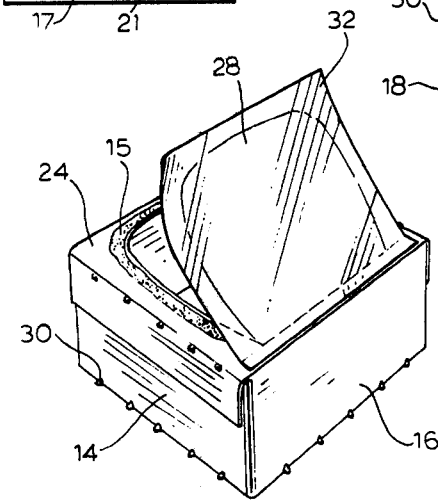

FIG. 3 is an enlarged illustration of the corner construction at a vent opening;

FIG. 4 is a section along the line 4—4 but when the box is in a set-up position; and FIG. 5 shows the box set up but with the reclosable opening being raised.

The container blank has a base 10; side walls 12, 14, 16 and 18; web corner panels 20 and 22 at each corner; a top 24 hinged to side wall 16; a lip 26; and an opening flap 28 defined by a cut line and hinged to top 24. It is made of paperboard and the fold lines between the hinged panels are die formed but from the bottom rather than the top of the sheet as is usual practice.

The reason that the fold lines are formed from the bottom is associated with the formation of the breathing cuts. These cuts 30 are U-shaped, and at the fold lines. They extend across the fold lines. The base of the U extends beyond the centre of the crease, and when the fold line is folded in reverse to normal direction so that the concave side that is engaged by the die is on the outside as shown in FIG. 3, they separate from the board and form breathing holes. Forming the breathing holes in this way avoids punching small holes at the fold lines. Punching holes have the disadvantage that the punched out pieces can fall into the next sheet to be cut in production. If they fall in a crease, the carton is damaged. Forming the breathing holes in this way has a further advantage that the protruding U-shaped cuts give an easy gripping surface at the bottom corners of the containers as seen in FIG. 5.

An overlay sheet 32 of a plastics material, such as polyethylene is applied to the top of the container. This sheet is permanently secured to the opening flap 28 and releasably secured to the portions of the top wall 24 that are marginal to the opening that is formed when the flap 28 is raised. Polyethylene is a good material for the overlay sheet 32 and, in the case of polyethylene, the centre portion that overlies the hinged flap 28 is electrostatically treated for gluing to the hinged flap 28. The outer portions that overlie the marginal portions of the opening are not so treated. The portions of the top at the margins of the opening have a tacky adhesive 15 applied thereto. The hinged flap 28 has a permanent adhesive 17 between it and the hinged flap. Thus, as the overlay sheet is applied to the top of the container with an appropriate adhesive 17 applied to the centre portion thereof, it permanently adheres to the hinged opening flap and releasably adheres to the adhesive 15 at the marginal portions of the opening. The overlay sheet is in production applied to the blank by a cellophane window machine of standard design.

This arrangement in the finished container permits one to lift a corner of the overlay sheet against the force of the tacky adhesive. As it is lifted, it disengages from the marginal portions of the opening and carries with it the opening flap which is permanently adhered thereto whereby to form an opening in the top of the container as illustrated in FIG. 5. This will be referred to again later when the use of the device is described.

Figure 1:
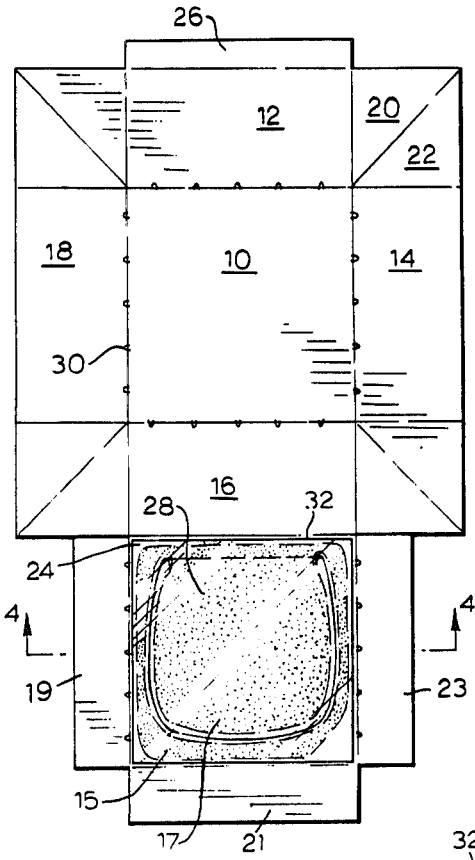
FIG. 1 is a view of the blank from which the container is formed.

In order to assemble the container, it is turned over as viewed in FIG. 1 and assembled in a standard machine for a heat sealed web corner carton with hot melt closed tri-seal flaps. The setup is not described in detail because it is well known, but generally speaking, the base of the blank is placed over an opening that is somewhat larger than the base. The base is depressed into the opening. As it is depressed, the side walls slide over the edges of the opening and are moved upwardly. The corner flaps that constitute the corner construction are actuated inwardly as indicated in FIG. 5. When the side walls of the box are at right angles to the base, heat is applied at the corners to fuse the triangular flaps and secure the walls in set-up position. The inside surface of the box is coated with a plastics material that is activated by heat and can be sealed by the application of heat.

It will be noted from FIG. 3 that the bottom and side walls of the box are folded in reverse direction to the normal direction of fold at the outside corners and that as the side walls are turned upwardly from the bottom of the container, the breathing cuts tend to remain flat and expose a breathing opening in the side walls adjacent the bottom.

The die cutting rules 31 that form the U-shaped cuts 33 are tapered upwardly at their cutting edges to that the cuts are wider at the surface from which the cut is made. The cut is made from the same surface as the crease lines 35 are formed. Because of the width of the cut 33 at the inside surface 37 the side edges of the tab slope outwardly of the inside surface of the tab as at 39. When two adjacent panels are folded to form a 90° angle with the wide opening of the cut being the inside corner, the wider top opening does not bind at the fold. The U-tab stays flat in the plane of the panel to which it is secured when the panels are folded as shown in FIG. 3. To achieve this, the panels are folded in the reverse direction to normal for the crease lines.

These U-shaped cuts extend outwardly from the bottom and do form an irregularity along the bottom edge that serves to provide a roughened gripping edge for the container. A popular use of the container is as a container for fishing worms or other fishing bait. These containers are often wet, and a surface that is easy to grip is an advantage for a container of this type.

The holes in the side walls of the container formed by the displacement of the tabs from the side walls are small. A dew worm can extend itself through a hole having a diameter of about 1/16 of an inch. The invention is specifically concerned with providing a ventilating opening of this order. It is the provision of a ventilating opening of about this size to avoid the problems of punching it that posed the problem prior to this invention. Ventilating openings of this order were previously formed by punching, but as indicated in the preamble to the specification the punching of small openings involves difficult problems of production. U-shaped tabs of this size will only remain flat and provide a ventilating opening as illustrated in FIG. 3 of the drawings when the walls are folded if the crease line is made on the inner face of the container. This is opposite to standard practice. In most cases the depression of the crease line is on the outer face of the container.

It is also of assistance in the formation of a tab that will remain in the plane of the bottom wall 10 as the side wall is folded, to have the U-shaped cut in the blank wider at the inside surface of the blank as formed by a tapered cutting die and explained above.

The length of the tab should also be such that the base does not extend into the side wall 16 a distance substantially greater than the width of the tab because otherwise the height of the opening would be greater than the width and exceed the dimension through which a worm can travel.

The ventilating opening of this invention is to be distinguished from the ventilating opening shown at the bottom of a container illustrated in U.S. Pat. No. 3,572,577 to Martin S. Dorfman for an invention entitled "Ventilated Tray". In that disclosure the ventilating openings are obviously of a larger proportion than those of this invention. They are not the kind of opening that would be formed by a small punch that is likely to foul. The tabs in the Dorfman disclosure are wider than they are long and they achieve their rigidity from their width. The tabs in the case of this invention are of necessity of a length greater than their width. This requirement is the requirement that restricts the invention to the small size hole. The tab is small and of necessity narrow, but in order to reach into the other wall it must be longer than its width. This is a requirement of a tab that will provide a small ventilating opening.

While 1/16 of an inch is the preferred maximum dimension for dew worms other kinds of bait which can extend themselves through small openings may be restricted by a larger opening and it is intended that the scope of this invention should include an opening up to 3/32 of an inch.

A further requirement of the invention apart from the length to width ratio of the tab for a small opening is that the fold line be depressed from the inside face of the blank as illustrated in FIG. 2.

When the side walls of the container are set up, the container is loaded with contents and the flap 26 is turned inwardly. Following that, the top is closed, the flaps 19, 21 and 23 at the edge of the hinged top are turned downwardly against the side walls and heat sealed thereto. The loaded container can then be shipped.

As indicated, the contents are often fishing bait, and in use the user, wanting to take a piece of fishing bait from the container, lifts a corner edge of the overlay sheet from the marginal portion of the top of the container as apparent from FIG. 5. As he does so, the overlay sheet separates from the tacky adhesive on the marginal edge of the top and the opening flap is hinged to an open position to expose the contents.

The required amount of contents is removed and then the closure flap is hinged again to the closed position. As it is done so, one applies slight pressure to the marginal edge portions of the container to press the overlay sheet into light contact with the adhesive that is on the top of the container. This again seals the opening.

It remains sealed until the requirement for removal of other contents from the container.

The overlay sheet is preferably made of a plastics material, such as polyethylene.

The container blank is made from paperboard. A paperboard of the semi-bleached sulphite type, wax impregnated and polyethylene coated on both sides made a good worm container in a thickness of about 0.018 inches. Other paperboards may be used for other purposes and it is not intended that the invention should be restricted to the specifications of the paperboard.

What I claim as my invention is:

1. A paperboard container blank having, an inside face and an outside face adjacent wall panels defined by fold lines that are die formed depressions in said inside face of the container blank;

U-shaped cuts in the blank each having two arms and a base, each arm having a free end and an end joining the base, said U-shaped cuts interrupting the fold lines to form U-shaped tabs, the direction of the arms of the U-shaped cuts being transverse of the direction of the fold lines, the tops of the arms of the U-shaped cuts being on a first one of two adjacent panels adjacent a fold line, and the base of the U-shaped cuts being in the second one of two adjacent panels;

said U-shaped cuts in said blank being wider at the inside face of the blank than they are at the outside face of the blank;

the distance between the arms of said U-shaped cut being less than 3/32 of an inch and the length of the arms being greater than the distance between them, the container being adapted for set up by folding said blank about said fold line whereby said U-shaped tabs separate from said second panel and remain in the plane of said first panel to leave a ventilating opening in said second panel at the corner between said first panel and said second panel when the container is set up.

2. A paperboard container blank as claimed in claim 1 in which the base of said U-shaped cuts is spaced from the foldline its respective U-shaped cut interrupts a distance not substantially greater than the distance between the two arms of its U-shaped cut.

3. A paperboard container as claimed in claim 1 or claim 2 in which the distance between the arms of the U-shaped cut is less than 1/16 of an inch.

* * * * *